US007472746B2

(12) United States Patent
Maier

(10) Patent No.: US 7,472,746 B2
(45) Date of Patent: Jan. 6, 2009

(54) PACKER APPARATUS WITH ANNULAR CHECK VALVE

(75) Inventor: Gary Allan Maier, Calgary (CA)

(73) Assignee: Halliburton Energy Services, Inc., Duncan, OK (US)

( * ) Notice: Subject to any disclaimer, the term of this patent is extended or adjusted under 35 U.S.C. 154(b) by 193 days.

(21) Appl. No.: 11/394,915

(22) Filed: Mar. 31, 2006

(65) Prior Publication Data

US 2007/0235194 A1 Oct. 11, 2007

(51) Int. Cl.
*E21B 33/12* (2006.01)

(52) U.S. Cl. ..... 166/129; 166/127; 166/148; 166/186; 166/191; 166/305.1; 166/387

(58) Field of Classification Search ..... 166/126, 166/127, 142, 148, 191, 387, 305.1, 186
See application file for complete search history.

(56) References Cited

U.S. PATENT DOCUMENTS 2,301,624 A * 11/1942 Holt
3,306,366 A * 2/1967 Muse
3,433,301 A * 3/1969 McEver, Jr.
4,151,875 A * 5/1979 Sullaway
4,590,995 A * 5/1986 Evans
5,456,322 A * 10/1995 Tucker et al.
5,488,994 A 2/1996 Laurel
5,738,171 A 4/1998 Szarka
5,832,998 A * 11/1998 Decker et al.
6,474,419 B2 * 11/2002 Maier et al.
2007/0068676 A1 * 3/2007 Shkurti ..... 166/308.1

OTHER PUBLICATIONS

Halliburton Services Sales and Service Catalog No. 40, pp. 3486 and 3487 (Undated but admitted to be prior art).

* cited by examiner

*Primary Examiner*—Giovanna C Wright
(74) *Attorney, Agent, or Firm*—John W. Wustenberg; McAfee & Taft

(57) ABSTRACT

A well packer assembly with an annular fluid bypass and a check valve. The well packer assembly has an upper packer apparatus and a lower packer apparatus with a stimulation port therebetween. An annular fluid bypass in the upper packer apparatus communicates the well annulus from above packer elements on the upper packer apparatus to below the packer elements. The well fluid circulated through the fluid bypass is discharged into the well annulus below the packer elements on the upper packer apparatus to circulate stimulation fluid through the stimulation port and upwardly through the upper packer apparatus and the tubing used to lower the upper packer apparatus into the well.

29 Claims, 10 Drawing Sheets

PACKER APPARATUS WITH ANNULAR CHECK VALVE

BACKGROUND

The invention relates to a well packer assembly and more specifically to a straddle packer assembly which has a fluid bypass in the upper packer apparatus to allow reverse circulation of stimulation fluid through the upper packer apparatus.

It is well known to use packers to sealingly engage the casing in a wellbore for a variety of different reasons. Packers are utilized for treating, fracturing, producing, injecting and for other purposes and typically can be set by applying tension or compression to the work string on which a packer is carried. Inflation-type packers which utilize packer elements that are inflatable with an inflation fluid are also commonly used. Packers are often utilized to isolate a section of wellbore which may be either above or below the packer.

Straddle packer assemblies which comprise upper and lower packer apparatus to engage and seal against a casing, or wellbore, are used to isolate a formation therebetween for stimulation or other treatment. Inflation-type straddle packers are well known. There are also straddle packers that include a compression packer and a cup packer, and straddle packers where both the upper and lower packer apparatus comprise compression, tension or hydraulic set type packers. In many cases, it is difficult to move the straddle packer assembly in the well after the stimulation process, in part due to the existence of proppant in the well annulus between the packers. There is currently no known method for reversing sand or other proppant used in a fracturing fluid from the straddle between the two packers in a two-packer compression, tension or hydraulic set system, while the packers are set. Thus, there is a need for a straddle packer apparatus using compression, tension and hydraulic set type packers which will provide for reliable retrievability and movability in a well, and which will provide for the circulation of sand or other proppant from between the straddle when both the upper and lower packers are set.

SUMMARY

The well packer assembly of the current invention includes an upper packer positioned above a lower packer with a ported sub therebetween. The upper packer has a plurality of first upper packer elements supported on a first tubular mandrel for sealing against a wellbore above a formation to be stimulated. A second tubular mandrel in the upper packer defines a central flow passage therethrough for communicating a stimulation fluid such as a fracturing fluid to the ported sub. A fluid bypass for communicating fluid in the well annulus above the plurality of packer elements to the well annulus below the plurality of first packer elements is defined by and between the first and second tubular mandrels. The bypass is preferably an annular bypass and will communicate fluid in the annulus above the first packer elements to fluid in the annulus below the first packer elements when the first packer is in its set position so that the first packer elements seal against the wellbore, and preferably a casing in the wellbore. A valve permits one-way flow from the annular bypass into the well annulus between the first packer elements and a plurality of second packer elements defined on the second packer but prevents flow in the opposite direction. The valve in the annular fluid bypass is preferably an annular check valve movable from the closed to the open position upon the application of fluid pressure in the annular fluid bypass. In an exemplary embodiment, the first packer elements are elements set by the application of a compressive force thereto, and the second packer elements are also set by the application of a compressive force thereto.

DETAILED DESCRIPTION

Figure 1:
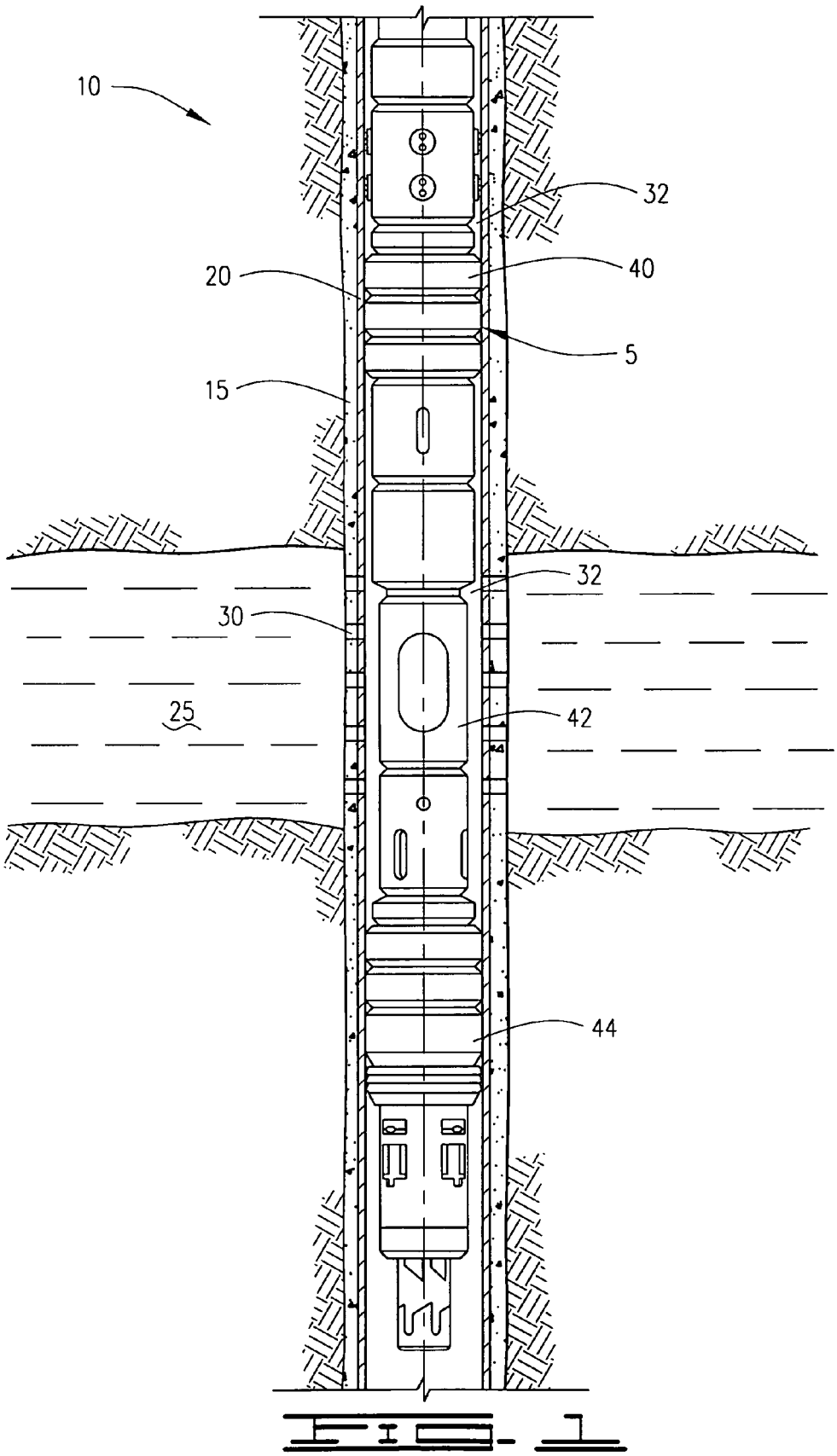
FIG. 1 schematically shows the well packer assembly of the current invention lowered into a wellbore.
Figure 2A:
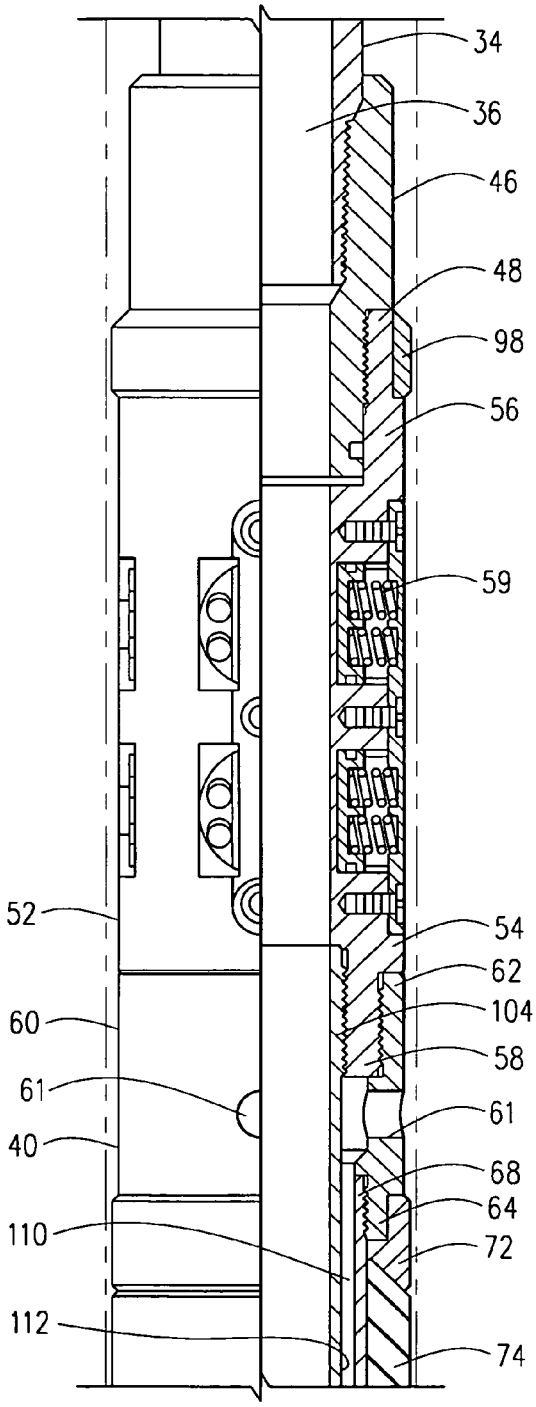
FIGS. 2A-2E are partial cross sections of the well packer assembly in an initial running position.
Figure 2B:
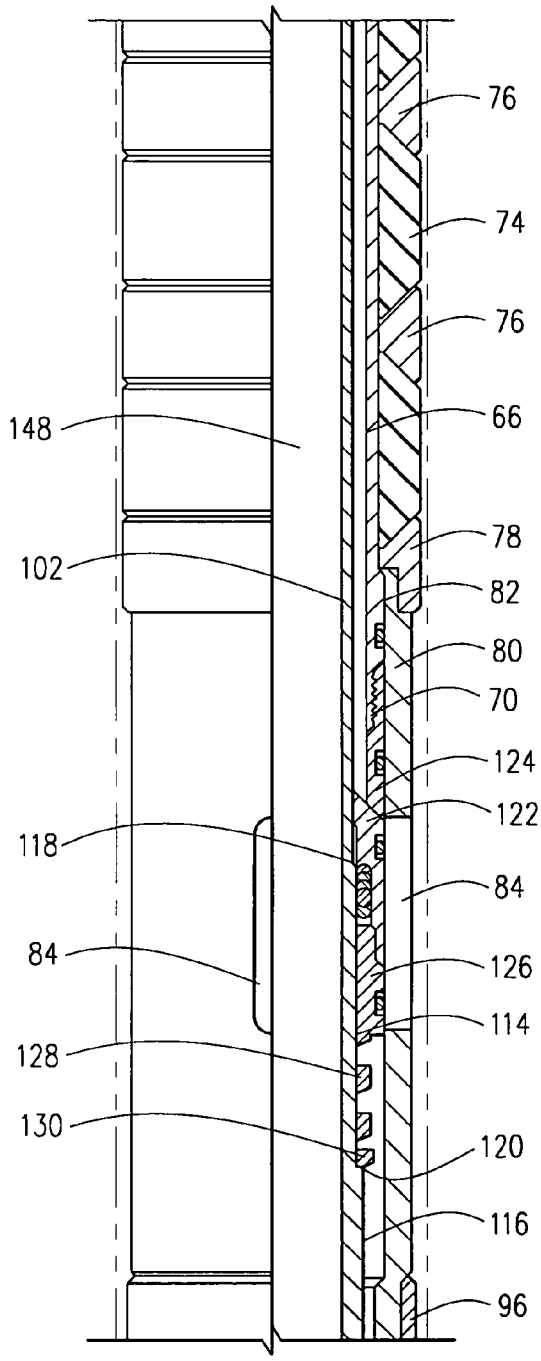
Figure 2C:
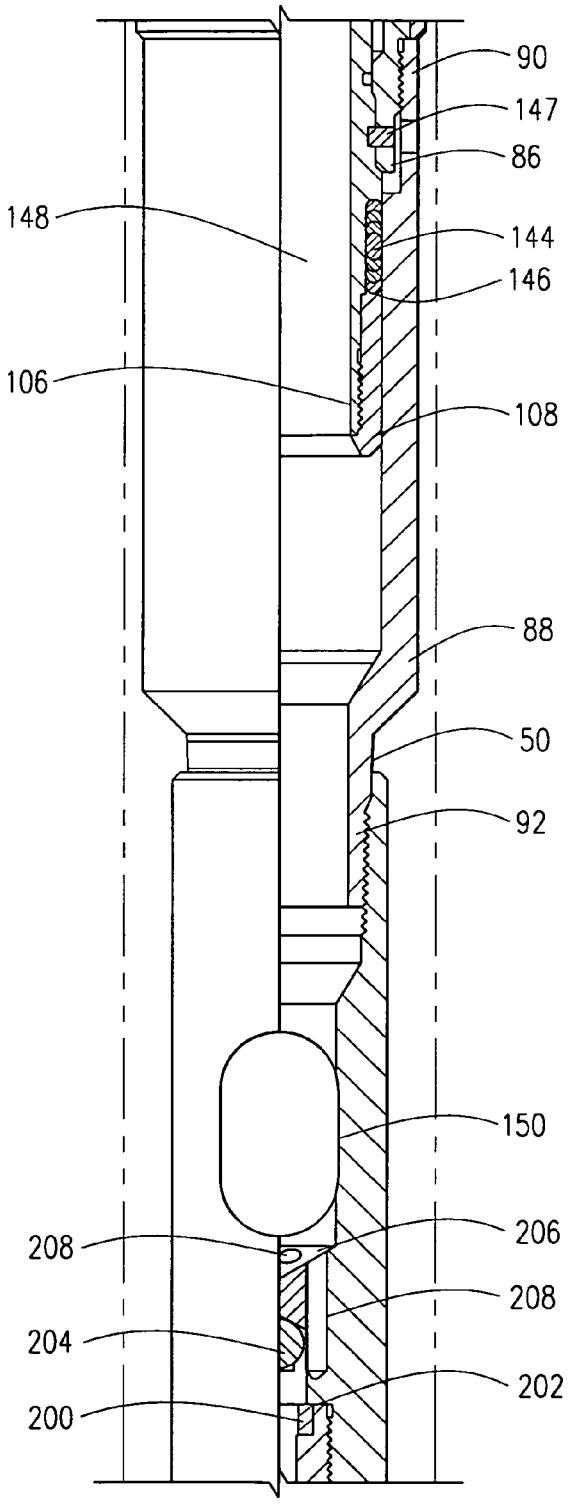
Figure 2D:
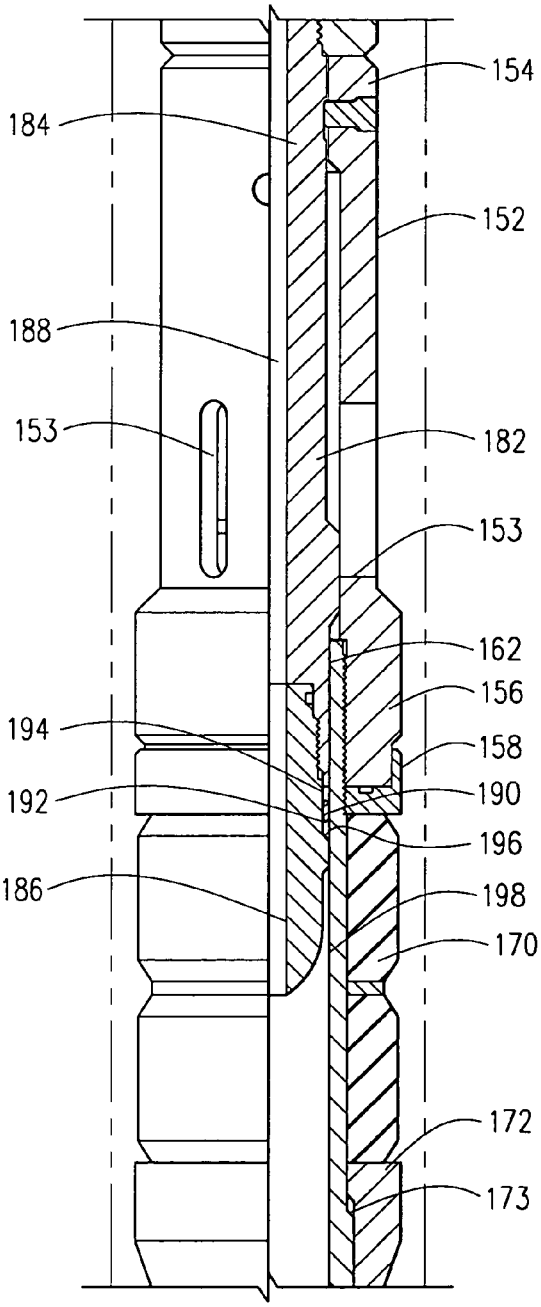
Figure 2E:
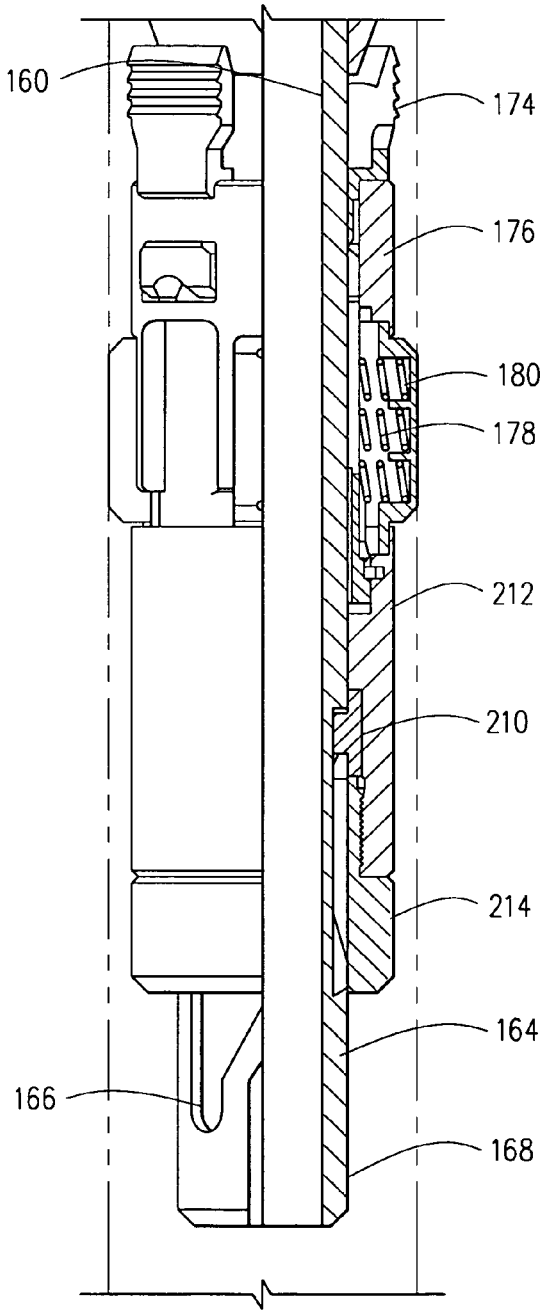
Figure 3A:
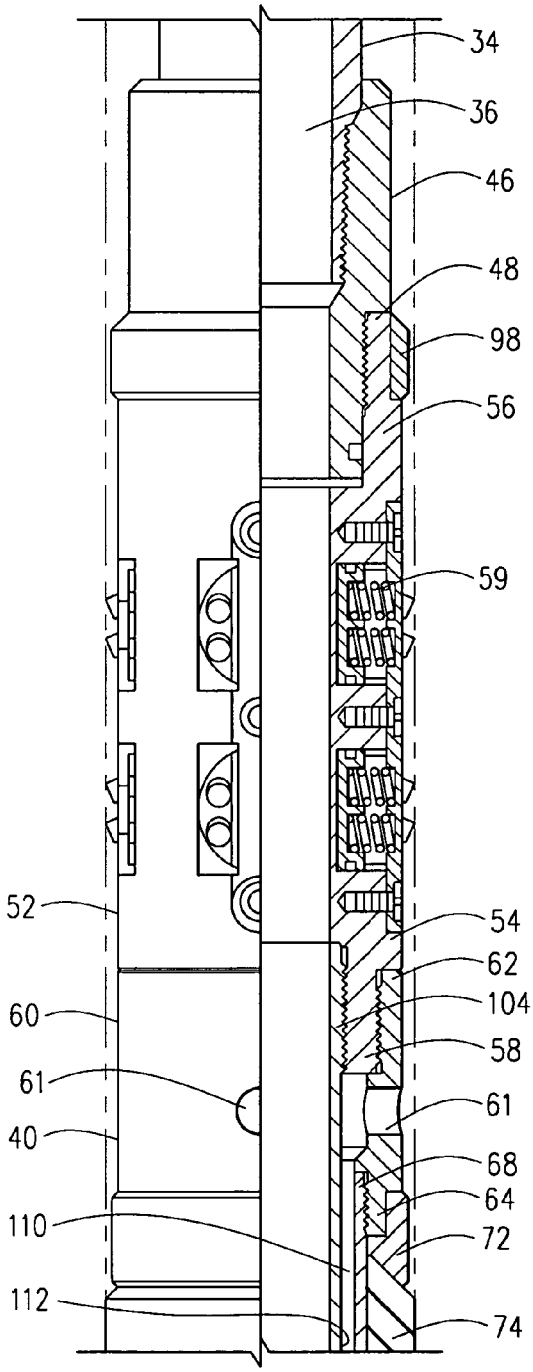
FIGS. 3A-3E are partial cross sections of the well packer assembly in a set position.
Figure 3B:
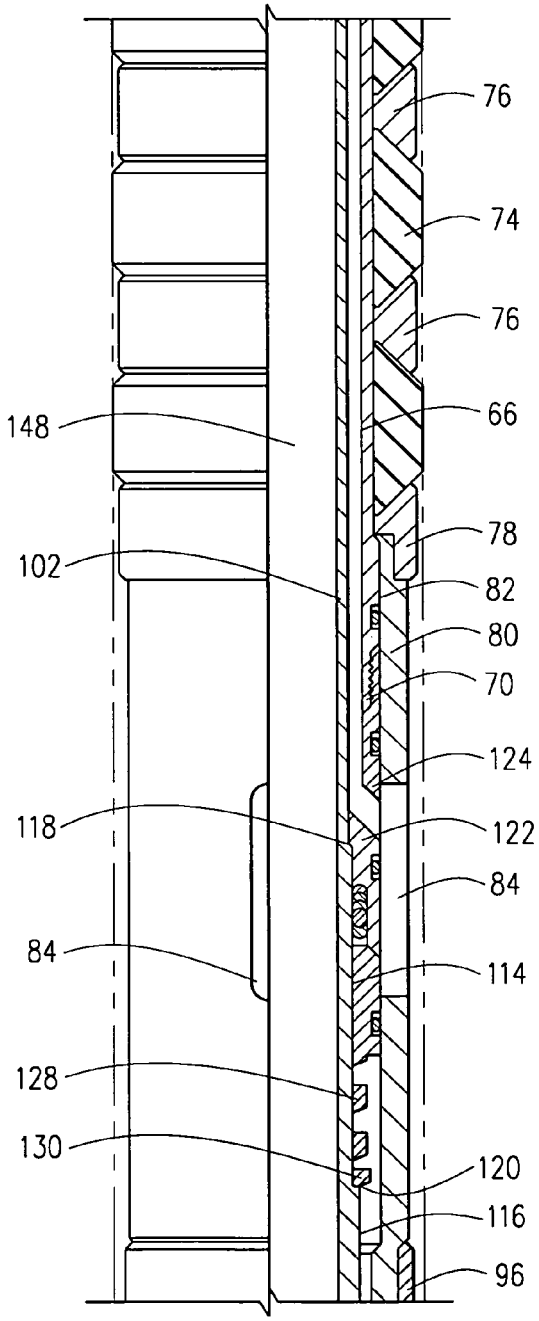
Figure 3C:
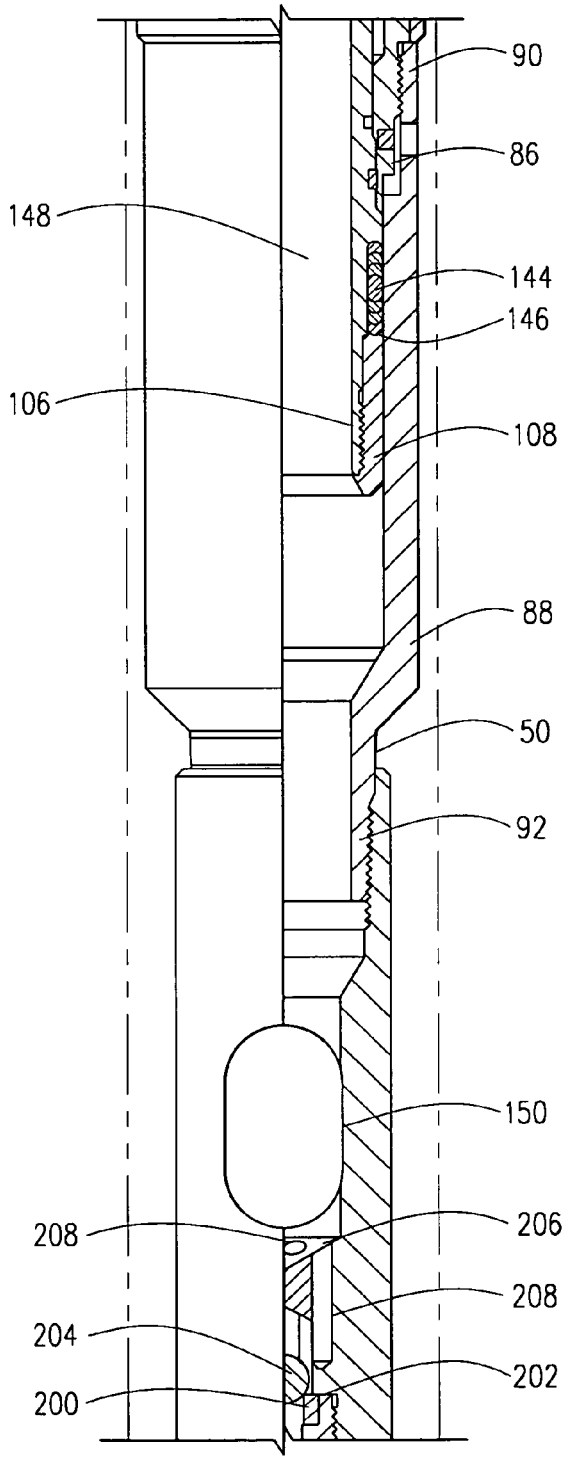
Figure 3D:
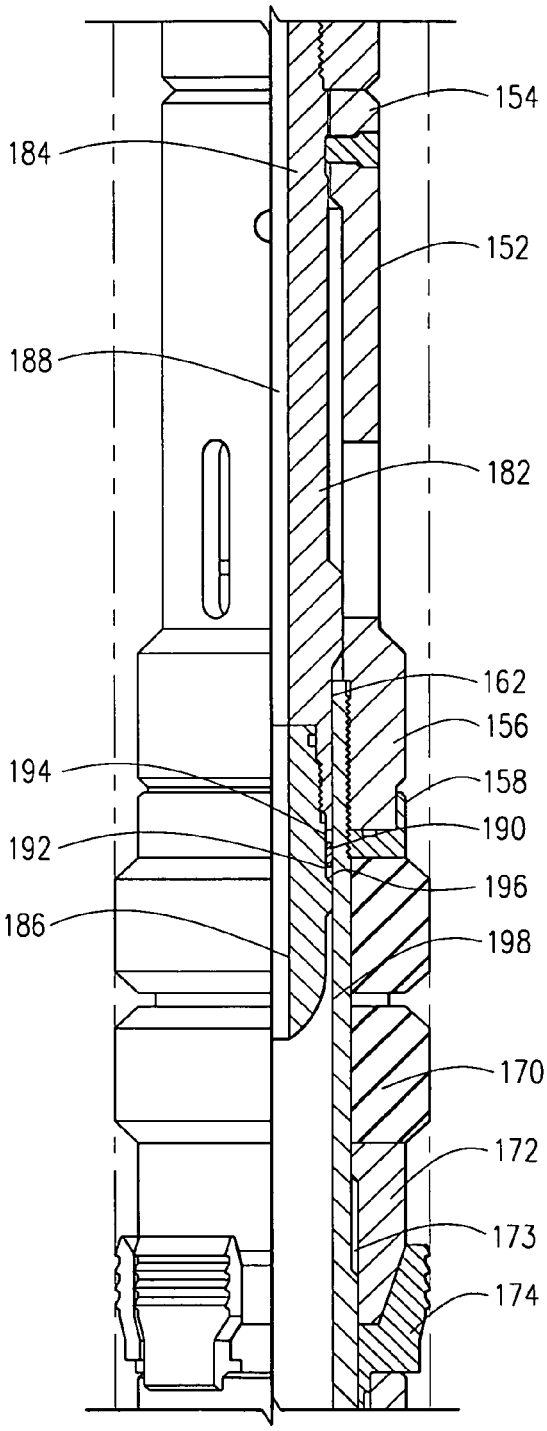
Figure 3E:
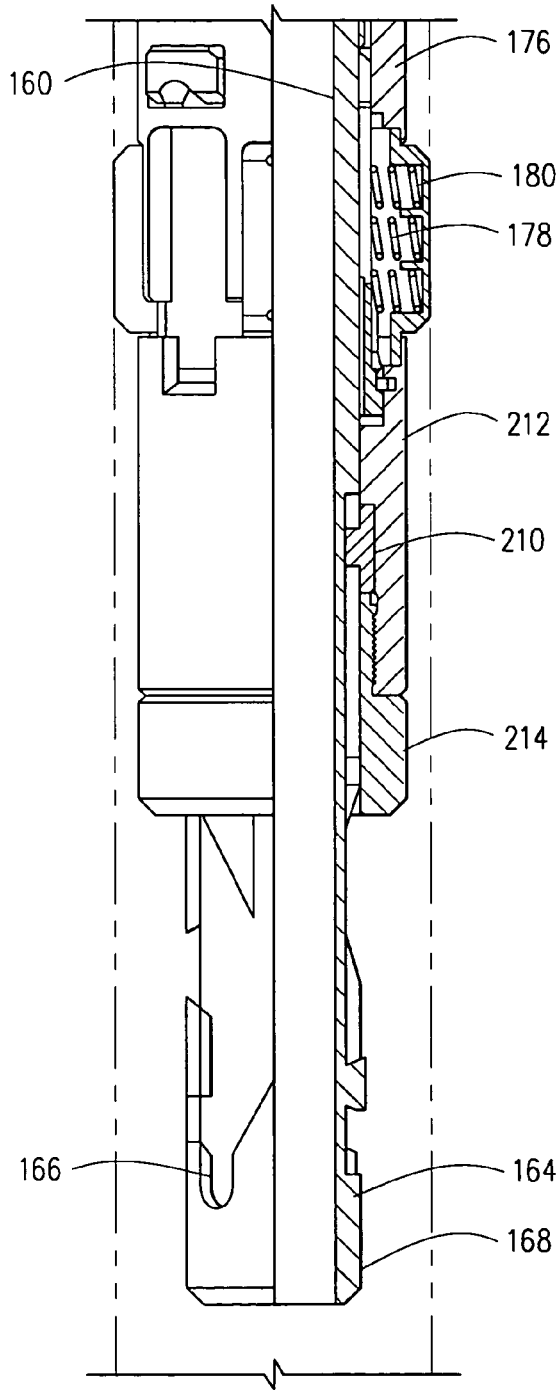
Figure 4A:
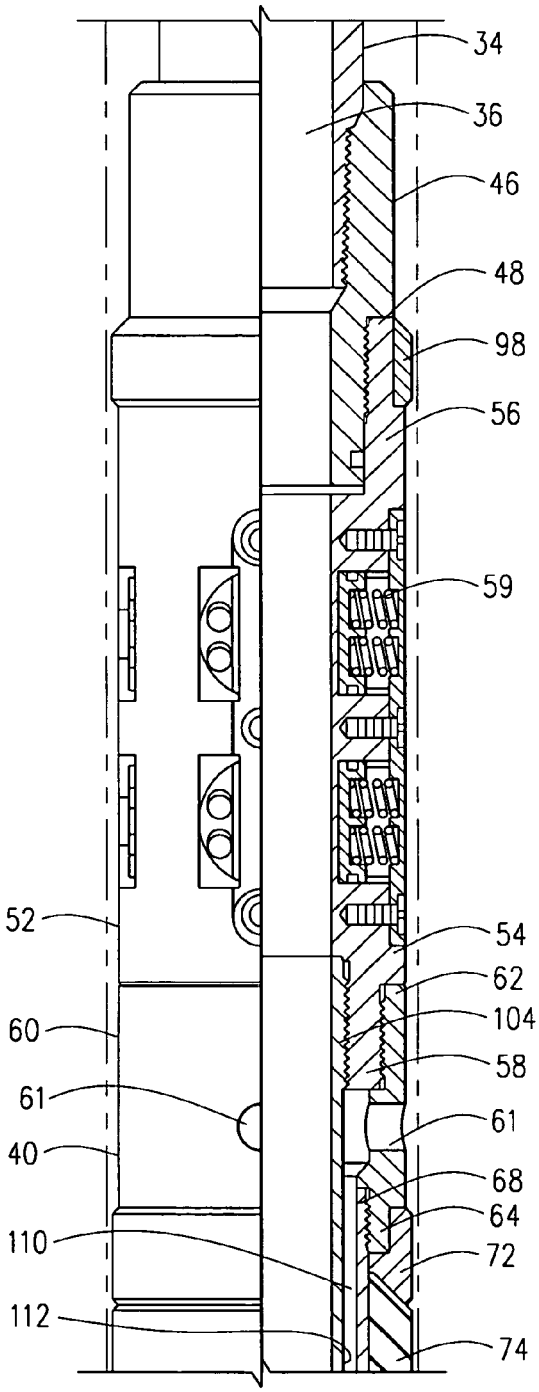
FIGS. 4A-4F are partial sections showing the well packer assembly in a retrieving position.
Figure 4B:
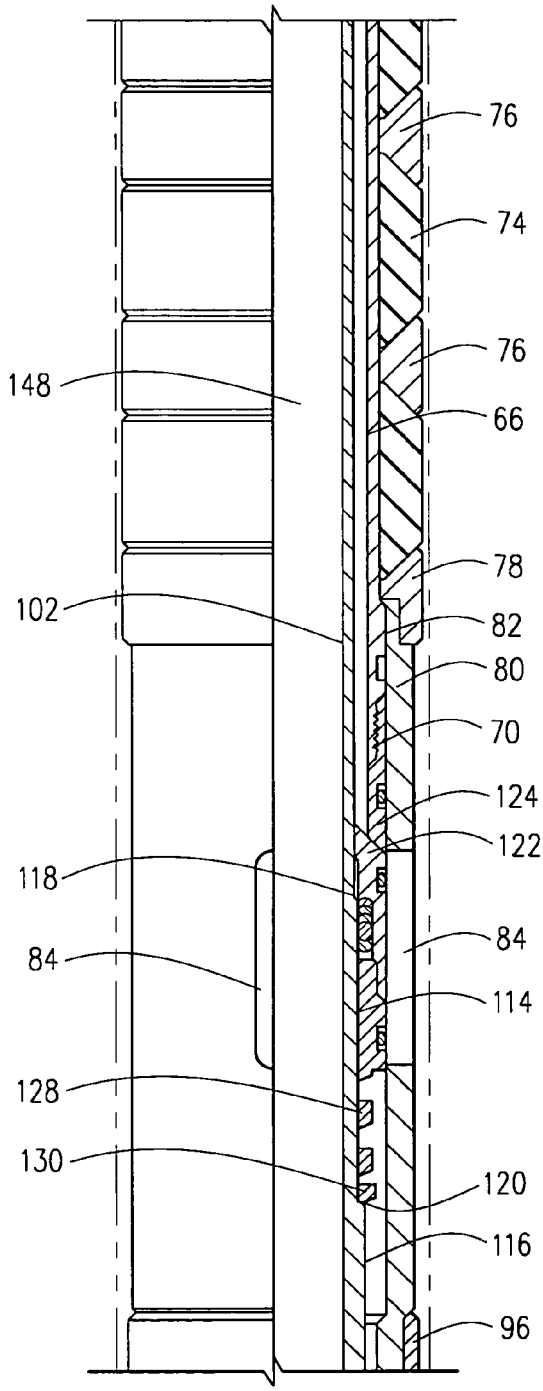
Figure 4C:
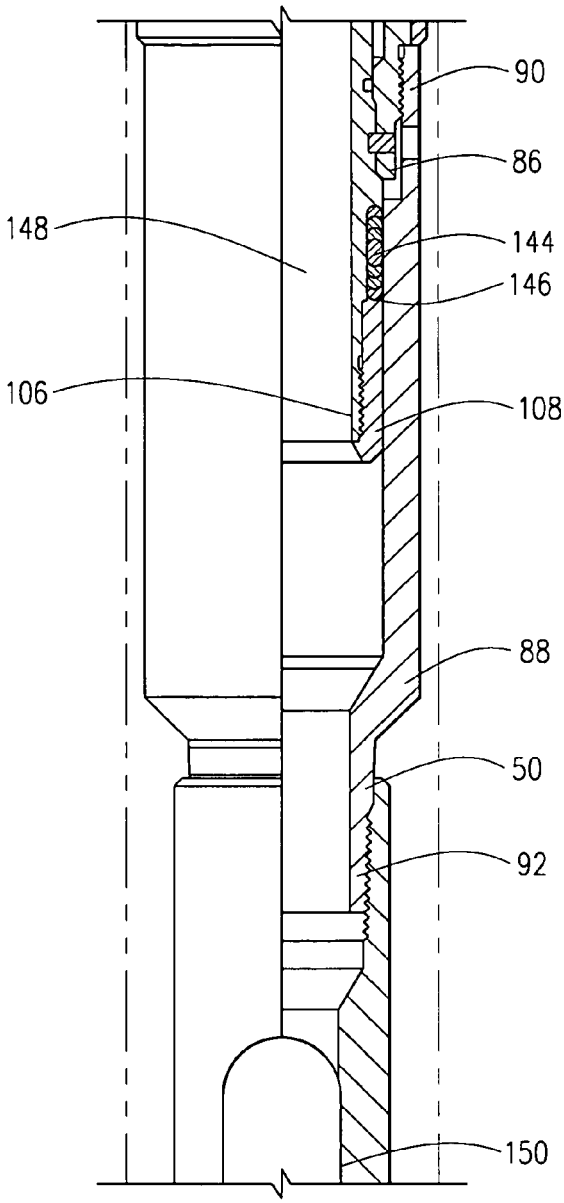
Figure 4D:
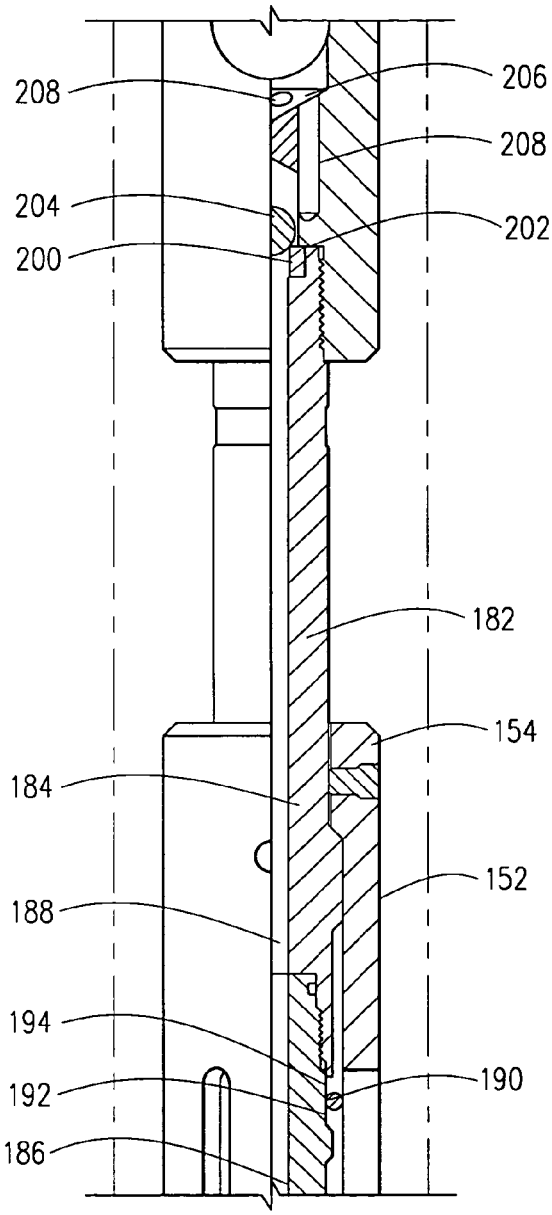
Figure 4E:
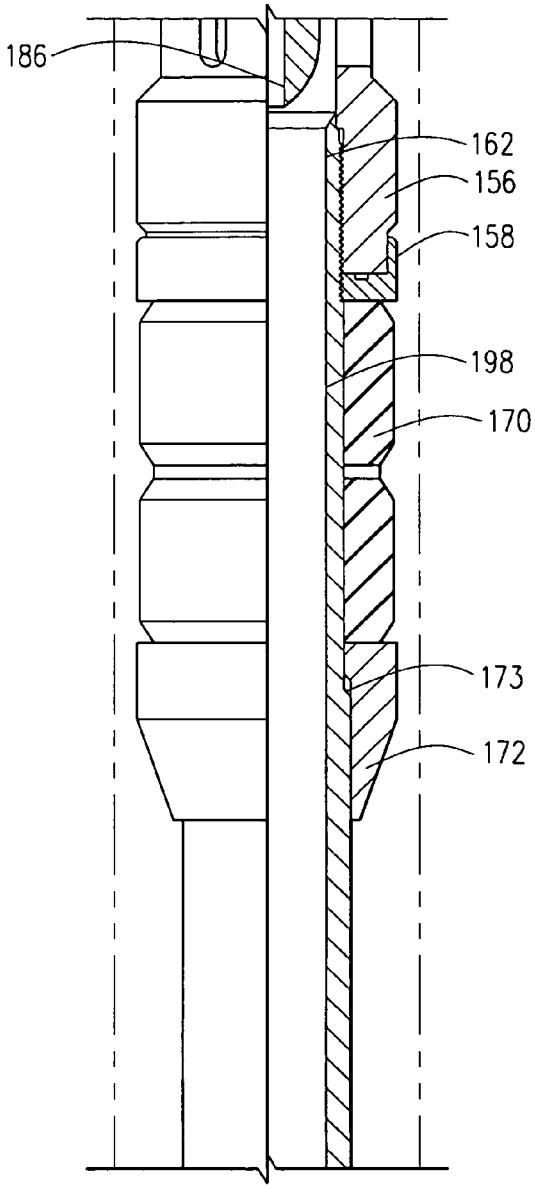
Figure 4F:
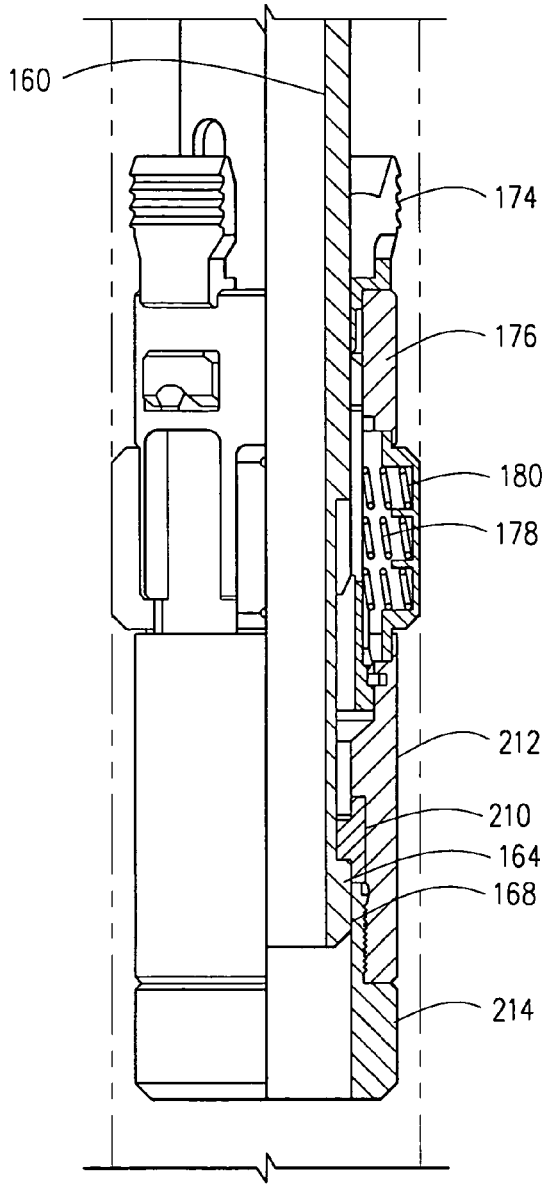

Referring now to the drawings and more particularly to FIG. 1, a well packer assembly 5, which may be referred to as a well stimulation tool 5, is shown lowered into a well 10 which comprises wellbore 15 with a casing 20 disposed therein which may be cemented in wellbore 15. Well 10 intersects a formation 25 which is communicated with well 10 through perforations 30 or other openings to communicate formation 25 with well 10. Fluid is communicated through the perforations 30 into a well annulus 32 defined by well 10 and well packer assembly 5 and tubing 34 which may be utilized to lower well packer assembly 5 into well 10 as shown is FIG. 2. Tubing 34 defines a longitudinal flow passage 36 through which fluid may be communicated to well packer assembly 5.

Well packer assembly 5 may comprise a first or upper packer apparatus 40, a ported sub 42 connected to the upper packer apparatus 40 and a second or lower packer apparatus 44 positioned below ported sub 42. A top sub 46 may be utilized to connect tubing 34 to well packer assembly 5. Top sub 46 is connected to well packer assembly 5 at the upper end 48 thereof which is also the upper end of first packer apparatus 40. First packer apparatus 40 also has second or lower end 50. Upper packer apparatus 40 includes a hydraulic hold-down 52 which includes a hydraulic hold-down body 54 that is threadedly connected at its upper end 56 to top sub 46 and at its lower end 58 to an inlet sub 60. Hydraulic hold-down 52 may be of a type known in the art and thus has hold-down slips 59 which will expand radially outwardly upon the application of hydraulic pressure. Inlet sub 60 has radial inlet ports 61 and is threadedly connected at an upper end 62 thereof to an outer thread at lower end 58 of hydraulic hold-down 52. Inlet sub 60 has a lower end 64 which is connected at an inner thread thereof to an outer or first tubular mandrel 66. Outer mandrel 66 has upper end 68, and lower end 70 and may be referred to herein as an element mandrel 66.

First packer apparatus 40 may also comprise a first, or upper packer end or upper packer shoe 72 threadedly connected to an outer thread at lower end 64 of inlet sub 60. A plurality of expandable packer elements 74 are supported on outer tubular mandrel 66 between upper packer shoe 72 and a second or lower packer end or packer shoe 78. Spacers 76 may be supported on outer mandrel 66 between packer elements 74. As will be explained in more detail hereinbelow, upper packer 40 is movable from a set to an unset position. Preferably, upper packer 40 is moved to the set position with the application of a compressive force to packer elements 74 which causes packer elements 74 to expand radially outwardly. In the unset position, an annular space exists between casing 20 and packer elements 74. In the set position, the packer elements 74 expand to engage casing 20 and thus to close well annulus 32.

Lower packer shoe 78 is threadedly connected to an outlet sub 80 at an upper end 82 thereof. Outlet sub 80 has radial outlet ports 84 between the upper end 82 and a lower end 86. A bottom connecting sub 88 is connected at upper end 90 thereof to outer threads defined on outlet sub 80. Bottom connecting sub 88 has a lower end 92. Upper packer apparatus 40 has a bottom guide ring 96 threadedly connected to outlet sub 80 and has an upper guide ring 98 threadedly connected to hydraulic hold-down 52. Lower end 86 of outlet sub 80 extends downwardly from the threaded connection between outlet sub 80 and bottom connecting sub 88.

An inner or second mandrel 102 is connected at an upper end 104 thereof to an inner thread at lower end 58 of hydraulic hold-down 52. Inner mandrel 102, which may also be referred to as a primary mandrel, has a lower end 106 threadedly connected to a retainer 108. First mandrel 66 and second mandrel 102 define a fluid bypass which is preferably an annular fluid bypass 110. Radial inlet ports 61 comprise the inlet to annular fluid bypass 110, and are positioned at, or near an upper end of annular fluid bypass 110. As will be explained in more detail hereinbelow, one-way flow may be allowed through annular fluid bypass 110 from radial inlet ports 61 through radial outlet ports 84.

Inner mandrel 102 has first outer diameter 112, second outer diameter 114 and third outer diameter 116. A first shoulder 118, which may be referred to as a valve stop 118, is defined by first and second outer diameters 112 and 114 while a second shoulder 120 which may also be referred to as spring retainer 120 is defined by second and third outer diameters 114 and 116, respectively.

Figure 5:
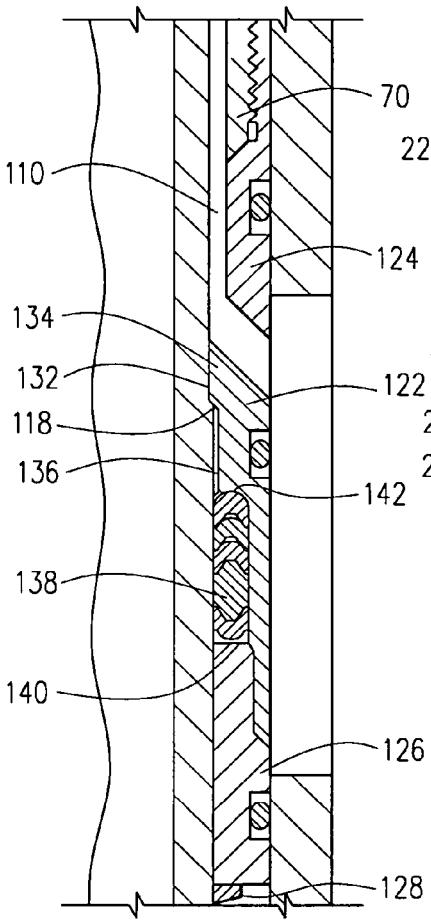
FIG. 5 is an enlarged view of a portion of FIG. 3 showing the bypass valve in an open position.

Upper packer apparatus 40 includes a valve 122 disposed about inner mandrel 102. In a closed position, as shown in FIGS. 2 and 3, no fluid flow is occurring through annular fluid bypass 110. Valve 122 prevents fluid flow in the direction from radial outlet port 84 to radial inlet port 61. A valve seat 124 is positioned above valve 122, and is threadedly connected at lower end 70 of outer mandrel 66. A valve retainer 126 threadedly connected to valve 122 is positioned therebelow and disposed about inner mandrel 102. A spring 128 is disposed about inner mandrel 102 and applies an upwardly directed force which may be referred to as a closing force on valve retainer 126 which applies the force to valve 122. Spring 128 is supported by a spring retainer 130 which is supported on second shoulder 120. The closing force applied by spring 128 will urge valve 122 toward and into engagement with valve seat 124. Valve seat 124 may provide a metal seat or may have a groove machined therein with a seal comprised of an elastomeric or Teflon®-type material to create a seal. Valve 122 has first inner surface 132 defined on a lip 134 that extends radially inwardly from a second inner surface 136 as shown in FIG. 5. First inner surface 132 is slidable on second outer diameter 114 of inner mandrel 102. A plurality of seals 138 are positioned between an upper end 140 of valve retainer 126 and a shoulder 142 defined on valve 122. A plurality of seals 144 is also positioned in an annular space defined by lower sub 88 and inner mandrel 102 between an upper end 146 of retainer 108 and a shoulder defined by inner mandrel 102. A shear pin 147 connects outlet sub 80 to inner mandrel 102.

Upper packer 40 defines a longitudinal central flow passage 148 to allow the flow of fluid therethrough into ported sub 42 which is threadedly connected to upper packer apparatus 40 at lower end 92 of bottom connecting sub 88. Ported sub 42 has flow ports 150 therethrough. As will be explained in more detail hereinbelow, one-way fluid flow is permitted through annular fluid bypass 110 when upper packer apparatus 40 is in its set position and a circulation fluid is displaced into the well annulus 32 above packer elements 74 at a flow rate sufficient to move valve 122 to an open position. One-way flow only is permitted since valve 122 will prohibit or prevent the flow of fluid from well annulus 32 in the direction from radial outlet ports 84 to radial inlet ports 61.

Second packer apparatus 44 comprises a top housing 152, which may be referred to as an equalizer valve housing 152. Equalizer valve housing 152 has an upper end 154 and lower end 156. An upper packer ring or upper packer shoe 158 is threadedly connected at lower end 156. A packer mandrel 160 is threadedly connected at its upper end 162 to internal threads on equalizer valve housing 152. Packer mandrel 160 has a lower end 164, and a continuous J-slot 166 near lower end 164. J-slot 166 may be referred to as an auto J-slot 166, since upward and downward pull will translate into rotation because of the J-slot configuration. J-slot 166 is defined in an outer surface 168 of packer mandrel 160. A plurality of packer elements 170 are supported on packer mandrel 160 between upper packer shoe 158 and a wedge 172 supported on a shoulder 173 defined on the outer surface of packer mandrel 160. A plurality of slips 174 are retained on packer mandrel 160 by a drag block housing 176. Drag block housing 176 is disposed about packer mandrel 160 and may include drag springs 178 and drag blocks 180. Drag springs 178 will urge drag blocks 180 outwardly into engagement with casing 20. Such an arrangement is known in the art.

An equalizing valve 182 comprising an upper valve section 184 and a lower valve section 186 is threadedly connected to ported sub 42. Equalizing valve 182 defines a valve bore 188 therethrough. A seal 190 is disposed about an outer surface 192 of lower valve section 186 between a lower end 194 of upper valve section 184 and a shoulder 196 defined on the outer surface of lower valve section 186. Seal 190 sealingly engages a mandrel bore 198 of packer mandrel 160. Equalizing valve 182 has a seat 200 at the upper end 202 thereof which may be engaged by a sealing ball 204 that is retained in ported sub 42. A decreased inner diameter portion 206 of ported sub 42 retains sealing ball 204, and has flow passages 208 therethrough to allow fluid flow.

FIG. 1 schematically shows a set position of the well stimulation tool 5, and FIG. 2 shows the running position of the well stimulation tool 5. As well stimulation tool 5 is lowered into well 10 with tubing 34, fluid may be circulated therethrough from the bottom since sealing ball 204 will not be seated as well stimulation tool 5 is lowered. If desired, pup joints or blast joints may be connected between upper packer apparatus 40 and ported sub 42 to lengthen stimulation tool 5. Once the selected formation for treatment is reached, the formation may be stimulated by fracturing with a proppant containing fluid.

Figure 6:
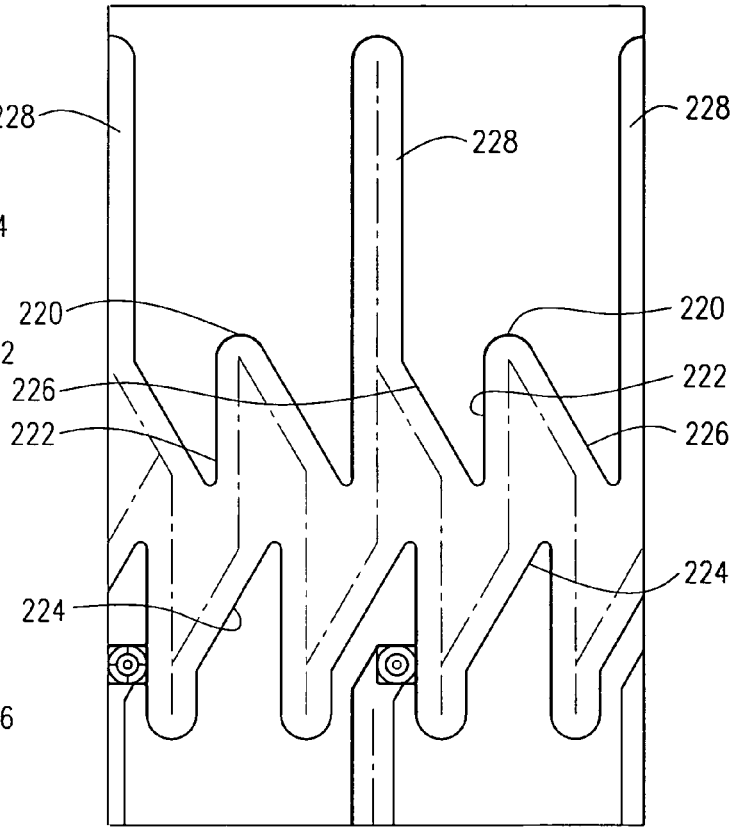
FIG. 6 is a flat pattern of the J-slot in the mandrel.

As seen in FIG. 2, rotating lugs 210 are mounted to a drag block retainer 212, which is disposed about packer mandrel 160 and is slidable relative thereto. Lugs 210 extend inwardly into J-slot 166, and may be held in place with a lug holder 214. In the running position, each of lugs 210 will be positioned at the top 220 of one of short legs 222 of J-slot 166 which is shown in the flat pattern of J-slot 166 in FIG. 6. Prior to treatment of the formation, well stimulation tool 5 is set in well 10 by moving both upper packer apparatus 40 and lower packer apparatus 44 to their set positions. To move upper and lower packer apparatus 40 and 44 to their set positions, upward pull is applied. Drag blocks 180 will engage casing 20, and slips 174, drag block housing 176, and drag block retainer 212 will be held in place as packer mandrel 160 moves upwardly relative thereto. As upward pull is applied, lugs 210 will move relative to J-slot 166 and engage one of lower ramps 224 which will cause rotation of the lugs 210 relative to packer mandrel 160. Weight can then be set back down and each of lugs 210 will engage one of upper ramps 226 which will cause continued rotation and will allow lugs 210 to be received in one of long legs 228 and move upwardly therein. When weight is set down and lugs 210 move upwardly in long legs 228, slips 174 will be received about wedge 172 and will expand and engage casing 20. Continued downward pressure will cause the expansion of packer elements 170 into casing 20 and will also cause shear pin 147 to shear. Inner mandrel 102 and upper packer shoe 72 will move downwardly and upper packer shoe 72 will apply downward force to packer elements 74 which will expand outwardly to engage casing 20. Thus, lower packer apparatus 44 is preferably a packer which is moved to the set position to seal against casing 20 with the application of a compressive force to packer elements 170, which causes the packer elements 170 to expand radially outwardly.

Once upper packer apparatus 40 and lower packer apparatus 44 are set, stimulation fluid can be displaced through tubing 34 by pumping or other means known in the art, and through longitudinal central flow passage 148 of upper packer apparatus 40 and flow ports 150. The stimulation fluid may include any type known in the art such as, for example, a proppant containing fracturing fluid.

Once a sufficient amount of fracturing fluid has been displaced into the formation, it may be desirable to unset upper and lower packer apparatus 40 and 44 to retrieve well packer assembly 5 to the surface or to move well packer assembly 5 within well 10 for the purpose of stimulating another desired formation. Annular fluid bypass 110 provides reliable retrievability and movability within well 10.

Prior to moving well packer assembly 5, fluid flow through tubing 34 is stopped, and circulation fluid of a type known in the art is circulated into well annulus 32. Circulation fluid is displaced into well annulus 32 at a rate sufficient to overcome the spring force applied to valve 122 by spring 128 and move valve 122 from the closed position shown in FIG. 2 to an open position, shown in FIG. 5. Valve 122 will engage valve stop 118 which will prohibit further downward movement of the valve 122. Circulation fluid will enter inlet ports 61 in inlet sub 60 and pass through annular fluid bypass 110 between valve 122 and valve seat 124 through radial outlet ports 84 in outlet sub 80. Circulation fluid will be displaced into well annulus 32 below packer elements 74 which will be set against casing 20 and will enter flow ports 150 in ported sub 42. Any proppant or proppant-containing fluid in the annulus below packer elements 74 along with proppant-containing fluid or other stimulation fluid in central flow passage 148 will be circulated upwardly through tubing 34 to the surface.

Valve 122 provides one-way isolation between the annular fluid bypass 110 and central flow passage 148 in that circulation fluid from well annulus 32 above set packer elements 74 may be communicated to well annulus 32 below set packer elements 74, into ported sub 42 and communicated into central flow passage 148. Flow in the opposite direction is prevented by valve 122. Sealing ball 204 will be seated during fracturing and during the reverse circulation process to circulate proppant such as sand out of the well packer assembly 5. Once the desired amount of proppant is circulated out well packer assembly 5 and the hold-down slips 59 are equalized and retracted from the casing 20 as shown in FIG. 4, it can be easily moved in well 10.

To retrieve or to move well packer assembly 5 within well 10, an upward pull is applied which will disconnect equalizing valve 182 from equalizer valve housing 152 on lower packer apparatus 44. Equalizer valve 182 may be initially connected with a shear pin or other means known in the art to allow disconnection from equalizer valve housing 152. Upward pull will cause upward movement of inlet sub 60 and upper packer shoe 72 so that downward force applied to packer elements 74 is relieved and packer elements 74 will retract radially so that they are disengaged from casing 20. Continued upward pull will cause seal 190 to move past slots 153 in equalizer valve housing 152 so that pressure above and below packer elements 170 on lower packer apparatus 44 is equalized. Continued pull will cause upward movement of equalizer valve 182 which will engage a shoulder on equalizer valve housing 152, and which will pull packer mandrel 160 upwardly so that wedge 172 is removed from slips 174 which will retract radially. The packer elements 170 and slips 174 are retracted so that well packer assembly 5 may be moved upwardly or downwardly in the well 10. The well packer assembly 5 may be repositioned at a second, and then third and any number of formations to be treated and reset so that such formations may be treated as described herein and may be retrieved after all desired formations have been treated.

Thus it is seen that the present invention is well adapted to carry out the objects and attain the ends and advantages mentioned above as well as those inherent therein. While certain exemplary embodiments of the invention have been described for the purpose of this disclosure, numerous changes in the construction and arrangement of parts and the performance of steps can be made by those skilled in the art, which changes are encompassed within the scope and spirit of this invention as defined by the appended claims.

What is claimed is:

1. A well packer assembly comprising:

a plurality of first packer elements supported on a first tubular mandrel for sealing against a wellbore above a formation to be stimulated;

a ported sub positioned below the plurality of first packer elements;

a second tubular mandrel defining a central flow passage for communicating stimulation fluid to the ported sub, wherein the first and second tubular mandrels define a fluid bypass for communicating fluid in a well annulus above the plurality of first packer elements to a well annulus below the first packer elements;

a plurality of second packer elements for sealing against the wellbore below the formation; and a valve for permitting one-way flow from the fluid bypass into the well annulus between the plurality of first packer elements and the plurality of second packer elements and blocking flow in the opposite direction.

2. The well packer assembly of claim 1 wherein the valve is movable from an open position wherein one-way flow is permitted to a closed position.

3. The well packer assembly of claim 2 wherein the valve moves to the open position with the application of a pressure in the fluid bypass.

4. The well packer assembly of claim 2 wherein the fluid bypass comprises an annular bypass and the valve comprises an annular check valve.

5. The well packer assembly of claim 1 wherein the second packer elements comprise compression type packer elements set by the application of a compressive force thereto.

6. The well packer assembly of claim 5 wherein the first packer elements comprise compression type packer elements set by the application of a compressive force thereto.

7. The well packer assembly of claim 1 further comprising an inlet above the first packer elements for communicating fluid in the well annulus to the fluid bypass, and an outlet for communicating fluid from the fluid bypass into the well annulus below the first packer elements.

8. The well packer assembly of claim 1 wherein the valve comprises a check valve in the fluid bypass.

9. The well packer assembly of claim 8 wherein the fluid bypass is an annular bypass and the check valve is an annular check valve.

10. The well packer assembly of claim 9 wherein:

the annular check valve comprises a movable valve disposed about the second tubular mandrel and a biasing means for urging the movable valve to a closed position; and the movable valve is movable to an open position to allow fluid flow into the well annulus below the first packer elements upon the application of a fluid pressure in the fluid bypass.

11. A well packer assembly comprising:

an upper packer adapted to be connected to a tubing and lowered into the well, wherein the upper packer comprises a plurality of upper packer elements, and wherein the upper packer may be moved from an unset to a set position with the application of a compressive force to the upper packer elements;

a ported sub positioned below the upper packer for communicating stimulation fluid to a selected formation;

a lower packer comprising a plurality of lower packer elements movable from an unset to a set position with the application of a compressive force thereto, wherein the lower packer is positioned below the selected formation for sealing the well below the selected formation, and the upper packer defines a fluid bypass therethrough to permit fluid flow from a well annulus above the upper packer elements to the well annulus below the upper packer elements and into the ported sub from the well annulus below the upper packer elements and;

a check valve for allowing one-way fluid flow through the fluid bypass from the well annulus above the upper packer elements to the annulus below the upper packer elements when the upper packer is in its set position, and to prevent fluid flow in the opposite direction.

12. The well packer assembly of claim 11, wherein the fluid bypass is an annular fluid bypass, and the check valve is an annular check valve.

13. The well packer assembly of claim 11 wherein the upper packer further comprises an outer tubular member for supporting the plurality of upper packer elements and an inner tubular member defining a longitudinal flow passage for communicating stimulation fluid to the ported sub, wherein the fluid bypass is defined by and between the inner and outer tubular members.

14. The well packer assembly of claim 13 wherein the check valve is an annular check valve disposed in the fluid bypass for permitting one-way fluid flow from the fluid bypass into the well annulus below the plurality of upper packer elements from the well annulus above the upper packer elements when the upper packer is in the set position.

15. The well packer assembly of claim 11 wherein the upper packer further comprises an inlet sub with at least one radial inlet port for communicating the well annulus above the upper packer elements with the fluid bypass, and an outlet sub with at least one radial outlet port for communicating the fluid bypass with the well annulus below the plurality of upper packer elements.

16. A well packer assembly for stimulating a formation intersected by a well, comprising:

a lower packer for sealing against the well;

a ported sub positioned in the well above the lower packer and defining a stimulation port therethrough; and an upper packer for sealing against the well above the ported sub, wherein the upper packer defines a flow passage for communicating stimulation fluid into and through the stimulation port into the well, and an annular bypass for communicating a fluid in the well annulus through the upper packer into the well annulus between the upper and lower packers and into the stimulation port to reverse circulate stimulation fluid through the flow passage, wherein the annular bypass has an annular valve for permitting one-way fluid flow only.

17. The well packer assembly of claim 16 wherein the upper packer comprises:

a plurality of expandable packer elements disposed about a first tubular mandrel; and a second tubular mandrel defining the flow passage, wherein the annular bypass is defined by and between the first and second tubular mandrels.

18. The well packer assembly of claim 17, further comprising:

an inlet port for permitting fluid flow into the annular bypass, wherein the inlet port is positioned above the expandable packer elements on the first tubular mandrel; and an outlet port for communicating flow from the annular bypass into the well, wherein the annular valve prevents fluid flow into the annular bypass through the outlet port.

19. The well packer assembly of claim 16 wherein the annular valve comprises a pressure-actuated check valve.

20. The well packer assembly of claim 16 wherein a fluid pumped into the annular bypass will exit the tool into the well annulus below packer elements on the upper packer, and will reverse-circulate stimulation fluid through the ported sub and the flow passage in the upper packer.

21. A method of treating a formation with a well stimulation tool comprising an upper packer, a lower packer positioned below the upper packer and a ported sub connected to the lower packer between the upper and lower packer suspended from the ported sub, comprising:

lowering the well stimulation tool into the well;

setting the lower packer to seal against the well below the formation to be treated;

setting the upper packer to seal against the well above the formation;

pumping a stimulation fluid through a central passage defined by the upper packer and the ported sub into the formation; and pumping a circulation fluid from the well annulus above packer elements on the upper packer to the well annulus below the packer elements through a bypass positioned radially inwardly from the packer elements on the upper packer to circulate the stimulation fluid through the ported sub and upwardly through the upper packer.

22. The method of claim 21 further comprising preventing flow through the bypass in a direction from below the packer elements on the upper packer to the well annulus above the packer elements on the upper packer.

23. The method of claim 21 wherein the bypass is an annular bypass.

24. The method of claim 21 further comprising:

unsetting the upper and lower packers;

moving the well stimulation tool in the well;

setting the lower packer to seal against the well below a second formation to be treated;

setting the upper packer to seal against the well above the second formation;

pumping a stimulation fluid through the central passage defined by the upper packer and the ported sub into the second formation; and pumping circulation fluid from the well annulus above the packer elements on the upper packer to the well annulus below the packer elements through the bypass to circulate the stimulation fluid through the ported sub and upwardly through the upper packer.

25. A well packer assembly comprising:

a plurality of first packer elements supported on a first tubular mandrel for sealing against a wellbore above a formation to be stimulated;

a ported sub positioned below the first packer elements;

a second tubular mandrel defining a central flow passage for communicating stimulation fluid to the ported sub, wherein a fluid bypass is defined by the first and second tubular mandrels for communicating fluid from the well above the first packer elements to the well below the first packer elements;

a packer suspended from the ported sub for sealing the wellbore below the formation; and a check valve for permitting one-way flow through the fluid bypass into the well below the first packer elements, wherein fluid passing through the check valve will flow into the well and through the ported sub to circulate stimulation fluid out of the central flow passage.

26. The well packer assembly of claim 25 wherein the check valve is movable from a closed position to an open position with the application of a selected pressure in the fluid bypass.

27. The well packer assembly of claim 26 wherein the check valve comprises:

a movable valve disposed about the second tubular mandrel; and biasing means for urging the movable valve to the closed position, wherein the movable valve is slidable on the second tubular mandrel to the open position of the valve upon application of the selected pressure.

28. The well packer assembly of claim 25 wherein the first packer elements may be set to engage a casing in the well with the application of a compression force thereto.

29. The well packer assembly of claim 28 wherein the packer suspended from the ported sub is a compression set packer.

* * * * *